US006080924A

United States Patent [19]

Cowen et al.

[11] Patent Number: 6,080,924

[45] Date of Patent: Jun. 27, 2000

[54] ACOUSTICAL REFLECTOR

[76] Inventors: Norman Cowen, 9329 Kester Ave., Van Nuys, Calif. 91402; Christopher Weik, 4542 Kraft Ave., Studio City, Calif. 91602

[21] Appl. No.: 09/347,625

[22] Filed: Jul. 2, 1999

[51] Int. Cl.[7] ..... G10G 7/00

[52] U.S. Cl. ..... 84/453; 84/380 R; 84/385 R; 84/387 R

[58] Field of Search ..... 84/453, 380 R, 84/385 R, 387 R, 400; 181/155, 175, 176

[56] References Cited

U.S. PATENT DOCUMENTS

| | | | |
|---|---|---|---|
| 4,012,983 | 3/1977 | Ploeger | 84/400 |
| 4,356,880 | 11/1982 | Downs | 181/30 |
| 5,373,771 | 12/1994 | Weik et al. | 84/400 |

*Primary Examiner*—Robert E. Nappi
*Assistant Examiner*—Shih-yung Hsieh
*Attorney, Agent, or Firm*—Frank L. Zugelter

[57] ABSTRACT

An acoustical reflector (10) formed by a pair of assembled panels (17, 18), each of which including one or more mouths (45) spaced from one another in ring-like fashion about a centrally disposed opening (27) for the reflector (10), the panels (17, 18) rotatably adjustable independently of one another. Each pair of mouths (45) between the panels (17, 18) cooperate to provide a channel (47) through the panels (17, 18) in the adjustability of the panels. Channel (47) is variable in its capacity for transmitting sound through the reflector (10) and for reflecting sound by utilizing the reflecting surface of one of the outer panel faces (either 21 or 22) with a portion of a facing surface (either 23 or 24) of the alternate panel to reflect back the sound to its source or instrument player's ear(s) for a determination of tonal blend, accurate pitch, or volume balance. A grommet 33 is mounted in the centrally disposed openings (27) of the reflector (10) and about which the panels (17, 18) rotate or orient to one another to adjust the enlarging or reducing of the variable capacity of the channel (47) formed by the adjusted mouths (45). A spacer ring (40) on grommet (33) prevents the panels (17, 18) from scratching one another and projections (43) secured on a panel (17) eliminates wobbling, rotation, and scratching of the panels.

20 Claims, 3 Drawing Sheets

10
17
18
21
22
23
24
25
26
27
33
35
37
40
43
45
47
5

FIG. 7.
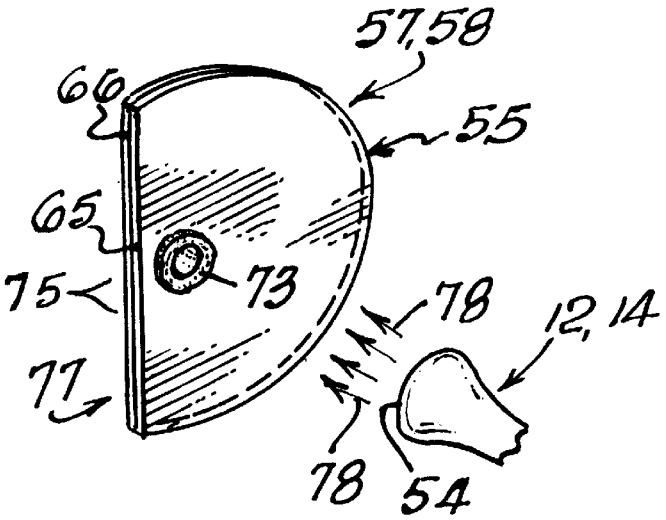
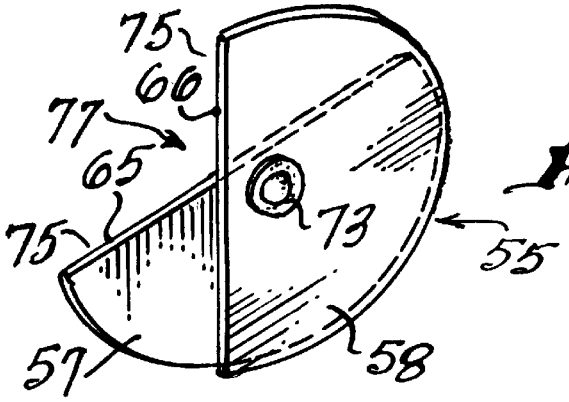
FIG. 8.
FIG. 9.
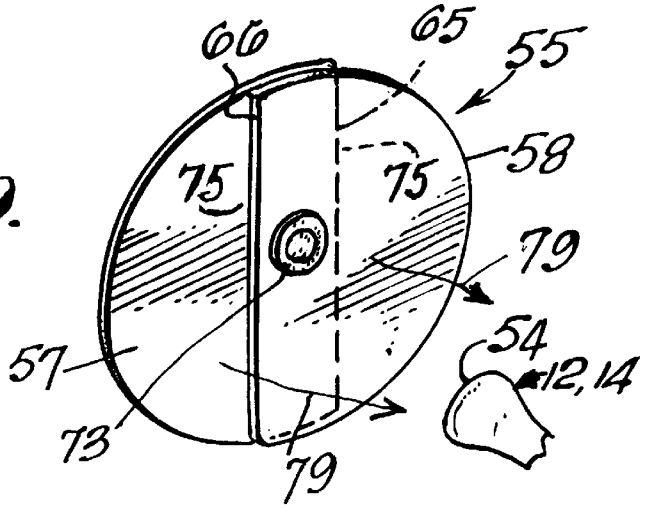

ACOUSTICAL REFLECTOR

TECHNICAL FIELD

This invention is directed to wind instruments and particularly relates to an adjustable acoustical reflector for producing reflection of sound waves that return to the ear of the wind instrument player, i.e., to return the sound waves to the vicinity of its/their source, to enable the player or instrumentalist to monitor his sound by hearing the instrument's sound in relation to the sound of other instruments of the player's group under varying or various conditions.

BACKGROUND TO THE INVENTION

Each player or instrumentalist must hear his own instrument in relation to those of others in a playing group in order that a satisfactory sound in his own instrument is produced by accurate pitch, proper volume balance, and proper tonal blend. In various or varying conditions, such as outdoor environs or halls, and/or wherever acoustics are poor or in need of certainty for the player, such production is difficult to achieve. With modern day communication equipment, such as a plurality of microphones for different kinds of instruments in a playing group, this invention provides the answer to a wind instrument player in the group and provides the need for the invention in the art.

SUMMARY OF THE INVENTION

The invention is embraced within a manufacture for a wind instrument, formed of a pair of panels face-to-face each having a ring of mouths and which panels are adjustable in relation to one another by rotating the one relative to the other. Rotation of one panel to the other enlarges or reduces the size of the mouths forming a channel through which sound flows through the acoustical reflector, while changing the effect of an acoustical reflection of the instrument's sound emanating from the face of the panel proximate to the ear(s) of the instrument's player. The acoustical reflector includes a central opening adapted to be mountable upon the neck of a microphone, or other support, that is positioned in front of but separated from the instrument being played. By rotating one panel relative to the other, the size or sizes of the mouths in the multiple number of panels are enlarged or reduced. Thus, the player can hear the reflected sound of his own instrument and in relation to those of the other players in the musical group and to assure himself that his instrument is producing the sound desired, under the particular conditions at the time of a playing and at the time of playing with and by the group.

An object of the invention is to provide an adjustable wind instrument acoustical reflector.

Another object of the invention is to hear inotation and to hear the tone quality of the wind instrument being played.

Another object of the invention is to provide an acoustical monitor that is adjustable for different performance venues or playing situations.

Yet another object of the invention is to hear and adjust the volume of other musicians in the playing group while providing a balanced volume or output control of the wind instrument being played.

A further object of the invention is to provide the elimination of annoying microphone feedback.

Still another object of the invention is to provide for a facile attachment to a microphone or other support rather than to the wind instrument itself as state-of-the-art acoustical reflectors presently do.

These and other objects and advantages of the invention will become apparent upon. a full and complete reading of the following description accompanied by its drawing comprising three (3) sheets of nine (9) FIGURES, and the appended claims hereto.

BRIEF DESCRIPTION OF THE DRAWING

FIG. 7 is a perspective view of another embodiment of the invention.

FIG. 8 is the view of FIG. 7, however, its panels being oriented to one another in a relationship other than that shown in FIG. 7.

FIG. 9 is another view of FIG. 7, with the relationship between the panels again being differently oriented to one another.

PREFERRED EMBODIMENT OF CARRYING OUT THE INVENTION

Figure 1:
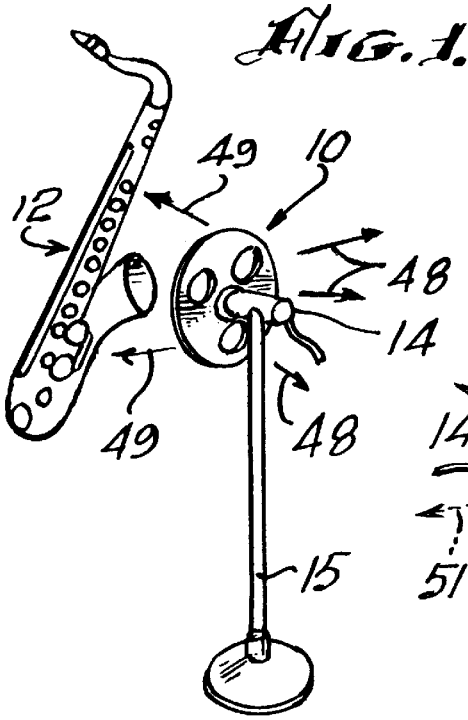
FIGS. 1 and 2 illustrate application to wind instruments of the subject matter of the invention.
Figure 2:
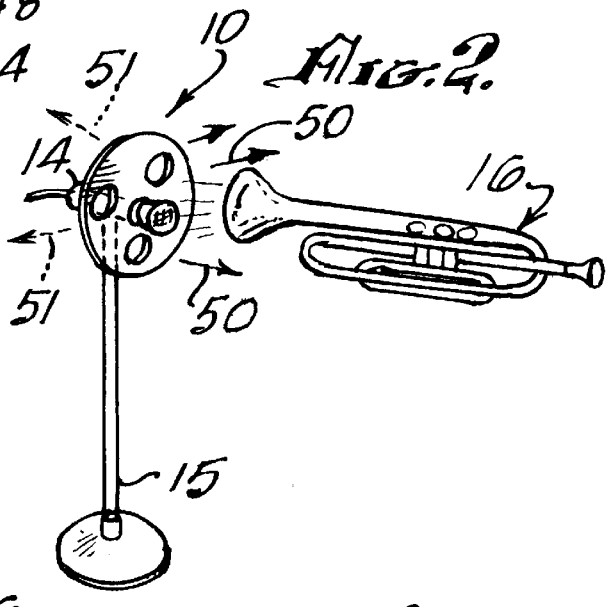

Referring now to the accompanying drawing in which reference characters correspond to numerals hereinafter, FIG. 1 illustrates the application of a manufacture or acoustical reflector 10 embracing the invention for and to a wind instrument such as a saxophone 12. Reflector 10 is mounted on the neck of a microphone 14 that is suitably supported on a stand 15 that is adaptable to the vicinity to the instrument's player or to the wind instrument itself, thus to the sound being produced and in which the invention is operable. FIG. 2 illustrates application of the acoustical reflector 10 that has been adjusted differently from that illustrated in FIG. 1, for and to another wind instrument, such as to a trumpet 16 by its mounting on the neck of the microphone 14 that is suitably supported on stand 15 in a manner such as that for FIG. 1.

Figure 3:
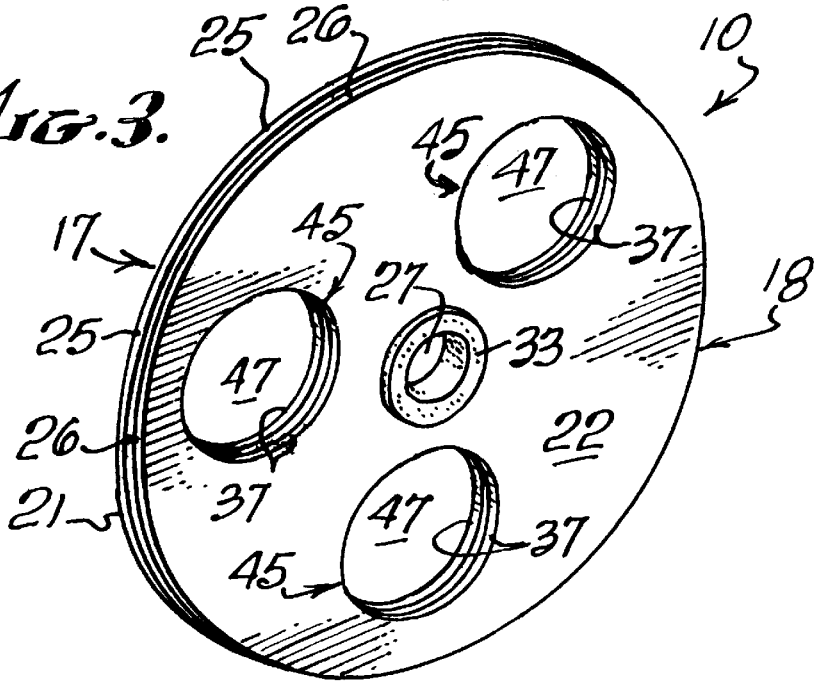
FIG. 3 is a perspective view of the acoustical reflector of the invention.
Figures 4, 5, 6:
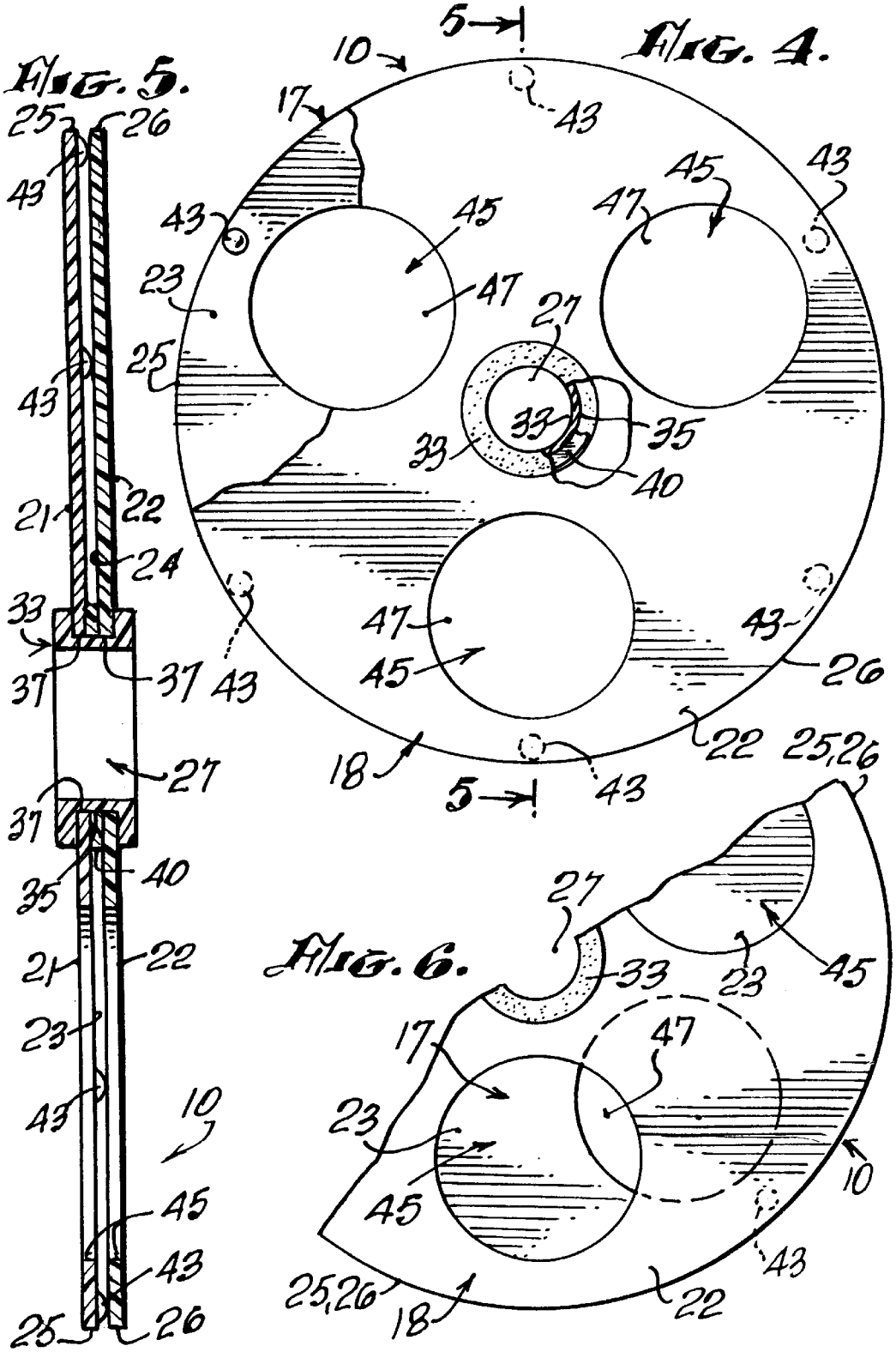
FIG. 4 is a frontal view, portions broken away, of the acoustical reflector of FIGS. 1, 2, and 3.
FIG. 5 is a view taken on line 5—5 of FIG. 4.
FIG. 6 is a fragmentary frontal view of FIG. 4, but modified by the rotation of the reflector's one panel to the other to show variable capacity for the mouths of the panels of the acoustical reflector.

Acoustical reflector 10 is formed, FIGS. 3–6, by a pair of panels 17, 18 having outer faces 21, 22, respectively, FIGS. 3, 5, and facing surfaces 23, 24, respectively, FIG. 5, the facing surfaces 23, 24 being matched to each other in assembly of reflector 10. Each panel 17, 18 is of a slim or thin configuration, with each having a periphery 25, 26, respectively, of a general circular configuration, that is in general alignment with the other. Each panel 17, 18 includes an opening both of which together form a centrally disposed opening 27 for acoustical reflector 10 in the assembly of the panels 17, 18 to each other. An apertured rubber grommet 33 that includes an annular groove 35 is utilized to assemble the panels 17, 18 together, and on which the panels are rotatable independently of one another. Edges 37 which form the noted openings in the panels together with the body formations forming outer faces 21, 22 of the panels abuttingly cooperate with the walls forming the annular groove 35 in grommet 33, to rotatably mount the panels to the grommet 33 in the assembly of acoustical reflector 10. A spacer ring 40 extends beyond the diameter of grommet 33 while being mounted thereto between the panels 17, 18, to maintain a spatial clearing between the inside facing surfaces 23, 24, one from the other. A plurality of relatively small projections or lugs 43 spaced separately from one another are securely mounted on the inside facing surface 23 of panel 17 (or on facing surface 24 or on both facing surfaces), usually in closer proximity, but not necessarily, to the panel's periphery 25 (or 26) than to the centrally disposed opening 27. Lugs 43 prevent rotation of one panel to the other that would change the desired capacity for the channel in the reflector (described more fully hereinafter), eliminates wobbling between the panels which could distort the reflected sound, and prevents scratching were the panels to rotate relative to one another. The depth of these projections 43 is generally equated or correlated to the thickness of the spacer ring 40.

In each panel 17, 18, a plurality of mouths or orifices 45, of the same size and of a geometrical configuration, are formed in ring-like manner about and at the same distance from opening 27, and are equally-spaced from one another in terms of degrees. When the panels 17, 18 are assembled to one another, and rotated so that a mouth in one panel directly and completely overlies a mouth in the other panel, a channel 47 of a maximum capacity, FIG. 4, is generated for each pair of cooperating mouths (one over the other) and as much sound as possible transmits or flows through each channel 47 of the reflector 10, as represented by arrows 48, FIG. 1, and consequently, a minimum of sound reflects off of the area of facing surface 23 to be heard by the instrument's player or reflected to the vicinity of the source of the sound, represented by arrows 49. In FIG. 2, wherein the panels have been adjusted so that the mouths 45 of the panels 17, 18 do not communicate at all to form a channel 47 of minimum (zero) capacity through the reflector 10, the nadir of flow of sound through the acoustical reflector 10 is illustrated. A maximum reflection of sound reflects back to the instrument player's ear(s), or to the vicinity of the source of the sound (the instrument), in the operation of the reflector 10, as shown by arrows 50, while arrows 51 represent no sound flowing through the acoustical reflector 10. FIG. 6 illustrates an adjustable flow or volume of sound through channel 47 for any portion, no matter how small (minimum) or how large (maximum), of a particular desired capacity for flow or transmission of sound through channel 47 of the reflector 10 it may be.

In operation, a microphone 14 is mounted to its stand 15 in a usual manner. The wind instrument player (not shown) takes place for playing in a usual manner by which the bell 54 of the player's wind instrument, such as shown in the saxophone 14 or the trumpet 18 in FIGS. 1 and 2, respectively, is disposed in front of or in an ordinary or regular proximity to the acoustical reflector 10 that is hung on the neck of microphone 14 by means of grommet 33, either one of the outer faces 21, 22 being directed towards the instrument's player or to the source of the sound. By playing the instrument 14, 18, or a like instrument, or by sound emanating from a source, the sound strikes the acoustical reflector 10 on one of the outer faces 21, 22. A player now is able to determine the characteristics of accurate pitch, proper tonal sound, and balanced volume, by rotating, adjusting, or orienting one panel relative to the other about grommet 23, thereby changing the capacity of the flow of sound through the mouths 45 so as to gain a desired reflection of sound from the outer face 21 or 22 facing the player's instrument. By such rotation, adjustment, or orientation, the noted characteristics to the ear(s) of the player (or another analyzer) is achieved by reducing or enlarging the capacity of the flow through channel 47. A maximum reflection of sound flows towards the instrument and to the player'ear(s), by closing off completely the mouths 45 on the one panel to the mouths 45 on the other panel. A minimum of reflected sound is transmitted towards the instrument and to the player's ear (s) by the mouths 45 on the one panel totally overlying the mouths 45 in the other panel. By rotating one panel to the other, varying degrees of transmitted and reflected sounds are made available to the instrument's player.

The panels 17, 18 can be fabricated from any relatively lightweight material, such as wood, sheet metal, or plastic, and preferably their acoustically reflective surfaces comprise simply the faces 21, 22 of their corresponding panels 17, 18 made of such materials. The panels may be transparent. The panels can have any one of numerous shapes, such as round as shown, or rectangular, polygonal, oval, slot-like, or other suitable geometrical configuration. The illustrated shapes of panels 17, 18 have proven satisfactory in use. The preferred materials (not necessarily limited thereto) are: Plexiglass for the panels 17, 18; Teflon for the spacer ring 40; rubber for grommet 33; and plastic "Bumpettes" manufactured and sold by the 3M Company, St. Paul, Minn., for the projections 43. The physical size of the illustrated acoustical reflector 10 includes a 10.5 inch diameter for panels 17, 18; a 1.4375 inch size for the opening in each panel 17, 18 by their edges 37; three (3)–3.0 inch holes forming each of the mouths 45, the center point for each mouth being at a distance of 3.12 inches from central opening forming each panel 17, 18, and being equally-spaced by having their center points at the same distance from the central opening forming each panel 17, 18 while being at 120 degrees, 240 degrees, and 360 degrees apart one to the next; with the thickness of each panel 17, 18 being 0.098 inch thick. State-of-the-art manufacturing processes are available for the production of these elements.

Spacer ring 40 prevents scratching between panels as they rotate relatively to one another, whether rotated in adjusting the panels' positions or a panel accidently rotating about grommet 33. Also, a negative distortion of sound may be transmitted by wobbling between the panels as force of sound strikes an outer face 21, 22. The "Bumpettes" or like elements maintain an unyielding stance between panels, preventing panel wobbling or rotation of either panel that could change the desired capacity once achieved for channel 47, while providing spacing to prevent scratching between the panels. However, without spacer or projections, the acoustical reflector 10 nevertheless functions.

In assembly, each "Bumpette" in spaced relation to another is applied to the panel's facing surface 23 of a fabricated panel 17. The backing on each "Bumpette" is removed and then directly applied to the clean facing surface 23, adhering thereto. Spacer ring 40 is set in place on facing surface 23, after which the fabricated panel 18 is mounted in place with the panels' openings 27 in alignment with one another. The apertured rubber grommet 33 is squeezed through the central openings 27, and the grommet's annular groove 35 is made to grasp readily the wall formation forming the outer faces 21, 22 and edges 37 of the panels 17, 18, thereby completing the reflector's assembly.

FIGS. 7, 8, and 9 illustrate an alternate embodiment 55 of the invention. A pair of panels 57, 58 are assembled together in the same manner as in the earlier described embodiment 10, however, two forms of peripheries are included in the panels. The peripheries 25, 26, are abbreviated, and boundaries 65, 66 in their corresponding panels 57, 58 take the form of geometrical curves, such as a straight cut as illustrated for each of them, and bisect their corresponding peripheries 25, 26, joining the ends of the abbreviated peripheries 25, 26 but not at ends of the abbreviated peripheries by which the boundaries would cross a grommet 73 (33) to which the panels 57, 58 are mounted and adjustably rotate thereon. The non-existent portions of the panels 57, 58, i.e., outside of their respective boundaries 65, 66, function as mouths 75, and together as a channel 77 extending through or past both panels 57, 58 for the acoustical reflector 55 itself, i.e., providing for a maximum capacity of flow of sound through it, shown by arrows 78, FIG. 7, and with a minimum capacity of flow of sound reflecting back to the player's instrument or to the source of the sound. Upon adjusting by rotation each of the panels 57, 58, the boundaries 65, 66 are no longer aligned with one another as in FIG. 7, but the flow of sound assumes other varying capacities passing through reflector 55 and reflecting back from reflector 55. While FIG. 7 illustrates a maximum capacity of flow of sound through reflector 55 and a minimum flow of sound being reflected from it, FIG. 9 illustrates a maximum capacity of flow of sound being reflected back from the reflector 55 and a minimum capacity of flow of sound (zero, in this instance) flowing through or past channel 77, illustrated by arrows 79. FIG. 8 illustrates by example a particular one of any number of variable capacities of channel 77 for flow of sound through reflector 55 via channel 77 and for flow of sound reflected back to the instrument's bell 54 or to the source of the sound. Channel 77 reduces in its capacity as panel 57 rotates clockwise to panel 58, and approaches the illustration of FIG. 9 as it does so.

Assembly, materials, and operation of this alternate embodiment are essentially the same as in the first described embodiment.

Thus, a particular capacity of flow of sounds via channels 47, 77, by changing the positions of the mouths 45, 75, respectively, by means of combining the positioning of the outer face of the one panel to which the sound is first directed towards the acoustical reflector with the positioning of the facing surface on the other of said panels, produces a desired reflection of sound, and thereby provides for determination of the noted characteristics in a particular instance desired by the instrument's player. Such orientations of the panels provide one to the other a particular selection of the noted characteristics, as desired by the player or at the source of the sound.

Various changes and modifications can be made in the manufacture or acoustical reflector 10 without affecting or limiting the scope of protection provided by the claims appended hereto. The sizes of the panels 17, 18 and mouths 45, 75 are not restricted to the illustrated sizes described above. When the mouths are smaller, a greater number of mouths can be included in each panel. Matched panels need not be of the same diameter as long as the mouths 45, 75 between each cooperating pair of panels cooperate together in the rotational adjustability of the panels so as to produce the corresponding channels 47, 77. The projections 43 all need not be mounted on a facing surface of only one of the panels, but one or more of them may also be mounted on the facing surface of another panel, as well as not necessarily being equated to the thickness of the spacer ring 40. The plurality of mouths or orifices 45, 75 in an acoustical reflector 10 need not all be disposed in a single ring-like manner as illustrated, but one or more of them can be disposed on one or more different ring-like configurations, as long as each cooperating pair of them in the panels cooperate with one another in the adjusting or orienting of one panel to another. The mouths need not be equally spaced from one another (i.e., 120 degrees apart from one another) but spaced at a greater or lesser number of degrees one from the next. The plurality of panels is not limited to two (2) panels, in which case an outer face of a panel functions as a facing surface that cooperates with the immediately adjacent outer face in the next panel which in turn functions as a facing surface in the adjustability of the panels one to another, to achieve the desired capacity of sound, through and reflected back from, for operation of the acoustical reflector.

We claim:

1. An acoustical reflector for a wind instrument or sound source comprising a plurality of panels each having a centrally disposed opening in their assembly to one another and being independently rotatably mountable about its corresponding opening, each of said panels including a facing surface matched to the facing surface of the immediately adjacent one of said panels and an outer face opposed to its corresponding facing surface, each of said panels including at least one mouth, the mouth of each of said panels generating a channel by rotational adjustability to provide variable capacities between maximum and minimum capacities for flow of sound through said acoustical reflector and for reflection of sound back to the wind instrument or its source.

2. The acoustical reflector of claim 1 including three mouths in each of said panels, the mouths formed in ring-like manner in each panel at the same distance from its corresponding centrally disposed opening.

3. The acoustical reflector of claim 1 including a plurality of mouths in the plurality of panels, the mouths formed in ring-like manner in their corresponding panels at the same distance from its corresponding centrally disposed opening.

4. The acoustical reflector of claim 1 or claim 2 or claim 3 wherein two panels constitute the plurality of panels.

5. The acoustical reflector of claim 4 including a grommet mounted in the centrally dispose openings, each of said panels via said openings being mounted to said grommet.

6. The acoustical reflector of claim 4 including means for spacing said panels one from the other mounted on said grommet.

7. The acoustical reflector of claim 6 wherein said grommet includes an annular groove, said panels mounted in said annular groove, said spacing means comprising a spacer ring mounted In the annular groove between said panels.

8. The acoustical reflector of claim 7 including projection means mounted on at least one of the facing surfaces.

9. The acoustical reflector of claim 8 wherein said projection means comprises one or more lugs.

10. The acoustical reflector of claim 1 or claim 2 or claim 3 including a grommet mounted in the centrally dispose openings, each of said panels via said openings being mounted to said grommet.

11. The acoustical reflector of claim 1 including a periphery on each of said panels said periphery being abbreviated, and a boundary joining together the abbreviated periphery and generating the channel for the panels in their assembly.

12. The acoustical reflector of claim 11 wherein said boundary comprises a geometrical curve.

13. The acoustical reflector of claim 12 wherein said geometrical curve comprises a straight line.

14. The acoustical reflector of claim 13 wherein two panels constitute the plurality of panels.

15. The acoustical reflector of claim 14 wherein a grommet is mounted in said centrally disposed opening, said panels rotatably mounted to said grommet.

16. The acoustical reflector of claim 15 wherein said grommet includes an annular groove, said spacing means comprises a ring mounted in said annular groove.

17. The acoustical reflector of claim 11 wherein a grommet is mounted in said centrally disposed opening, said panels rotatably mounted to said grommet.

18. The acoustical reflector of claim 17 including means for spacing said panels one from the other in the assembly of said panels.

19. The acoustical reflector of claim 18 wherein said grommet includes an annular groove, said spacing means comprises a ring mounted in said annular groove.

20. The acoustical reflector of claim 11 or claim 17 or claim 18 or claim 19 wherein two panels constitute the plurality of panels.

* * * * *

UNITED STATES PATENT AND TRADEMARK OFFICE

CERTIFICATE OF CORRECTION

PATENT NO. : 6,080,924

DATED : 6/27/2000

INVENTOR(S) : Cowen et al

It is certified that error appears in the above-indentified patent and that said Letters Patent is hereby corrected as shown below:

In col.6, actual line 49, "Including" is to be read as -- including --.

Signed and Sealed this

Third Day of April, 2001

*Attest:*

Nicholas P. Godici

NICHOLAS P. GODICI

*Attesting Officer*

*Acting Director of the United States Patent and Trademark Office*